US007731325B2

(12) United States Patent
Aoyama et al.

(10) Patent No.: US 7,731,325 B2
(45) Date of Patent: Jun. 8, 2010

(54) INK-JET RECORDING APPARATUS

(75) Inventors: Michiko Aoyama, Nagoya (JP); Masashi Tsuda, Ichinomiya (JP); Narumi Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 753 days.

(21) Appl. No.: 11/535,891

(22) Filed: Sep. 27, 2006

(65) Prior Publication Data

US 2007/0076043 A1 Apr. 5, 2007

(30) Foreign Application Priority Data

Oct. 3, 2005 (JP) ..... 2005-290116

(51) Int. Cl.
*B41J 2/165* (2006.01)

(52) U.S. Cl. ..... 347/25

(58) Field of Classification Search ..... 347/25
See application file for complete search history.

(56) References Cited

U.S. PATENT DOCUMENTS 5,786,829 A * 7/1998 Pasciak et al. ..... 347/28
5,877,788 A * 3/1999 Haan et al. ..... 347/28
2004/0183874 A1* 9/2004 Toyoda et al. ..... 347/86

FOREIGN PATENT DOCUMENTS

JP 1988092459 A 4/1988
JP 1996197742 A 8/1996
JP 1997216373 A 8/1997

OTHER PUBLICATIONS

Air Solubility in Water; The Engineering Toolbox; see Example—Calculating Air Dissolved in Water; <http://www.engineeringtoolbox.com/air-solubility-water-d_639.html>.*

* cited by examiner

*Primary Examiner*—Stephen D Meier
*Assistant Examiner*—Alexander C Witkowski
(74) *Attorney, Agent, or Firm*—Baker Botts, LLP.

(57) ABSTRACT

The invention relates to an ink-jet recording apparatus having a nozzle provided on a nozzle face of an ink-jet head and a cleaning device for cleaning the nozzle face. The cleaning device contains a gas with a solubility in water lower than that of air in water.

19 Claims, 2 Drawing Sheets

INK-JET RECORDING APPARATUS

BACKGROUND OF THE INVENTION

This application claims the benefit of Japanese Patent Application No. 2005-290116, filed Oct. 3, 2005, which is incorporated herein by reference.

1. Field of the Invention

The present invention relates to an ink-jet recording apparatus which ejects a water-based ink on a recording medium from a nozzle provided on a nozzle face of an ink-jet head.

2. Description of Related Art

In an inkjet recording method, an ink droplet is discharged from a fine nozzle, and then adheres onto a recording medium to form a recording. Various types of ink discharge methods may be used, including an electrostatic attraction method, a drop-on-demand method in which mechanical vibration or displacement is applied to an ink by using a piezoelectric element, and a thermal ink-jet method in which a bubble is generated by heating the ink.

An ordinary ink-jet recording apparatus is schematically shown in FIG. 3. This ink-jet recording apparatus 110 comprises a carriage 4 in which an ink-jet head unit 3 having an ink cartridge 1 and an ink-jet head 2 is mounted, a carriage drive unit (not shown) which reciprocates the carriage 4 along a carriage guide rod 5, a platen roller 6 which is disposed opposite to the ink-jet head unit 3 and transports a recording paper, a purge device 7 which aspirates the residual ink, which may contain bubbles or have an inappropriate composition, from the nozzle face 2*a* of the ink-jet head 2, and a rubber wiper 8 for wiping ink or a foreign matter from the surface of the nozzle face 2*a* at the home position.

Nevertheless, when the nozzle face 2*a* is repeatedly wiped by using the rubber wiper 8, there is a problem in that, for example, a fine scratch may sometimes be generated on the nozzle face or an ink repellant layer formed on an outermost surface of the nozzle face 2*a* may sometimes be removed. This causes the ink or dust tends to gradually deposit on the nozzle face 2*a*, which then leads to deterioration of recording quality.

The nozzle face 2*a* may also be cleaned in a non-contact matter by blowing off the ink or foreign matter using a gas.

SUMMARY OF THE INVENTION

Methods of blowing ink or foreign matter off the nozzle fact are described in JP-A No. 63-92459 and 8-197742, both incorporated by reference herein. However, when gas is used to clean the nozzle in this manner, bubbles may be formed in the water-based ink for ink-jet recording. This may result in printing failure when the bubbles prevent ejection of the ink.

The present invention may solve this and other problems by suppressing formation of bubbles in the water-based ink. The present invention relates to an ink-jet recording apparatus for recording by ejecting a water-based ink. In one embodiment, the apparatus comprises a nozzle provided on a nozzle face of an ink-jet head and a cleaning device for cleaning the nozzle face comprising a gas having solubility in water lower than that of air in water.

In a second embodiment, the invention relates to a method of cleaning a nozzle face of an ink-jet head comprising blowing a gas having a solubility in water lower than that of air in water at the nozzle face of the ink-jet head.

Other objects, features, and advantages will be apparent to those skilled in the art from the following detailed description and accompanying drawings.

BRIEF DESCRIPTION OF THE DRAWINGS

Embodiments of the invention are described in detail with reference to the following drawings.

DETAILED DESCRIPTION OF EMBODIMENTS OF THE INVENTION

The present inventors have found that, when the nozzle face of an ink-jet head is cleaned by blowing a gas on the nozzle face, bubbles may be generated in the water-based ink intended for ejection through the ink-jet head. These bubbles are generated when a gas having a relatively high solubility in water is used for cleaning. Bubble formation may be suppressed by using a gas that has a solubility in water lower than that of air found at the nozzle face in water.

Figure 1:
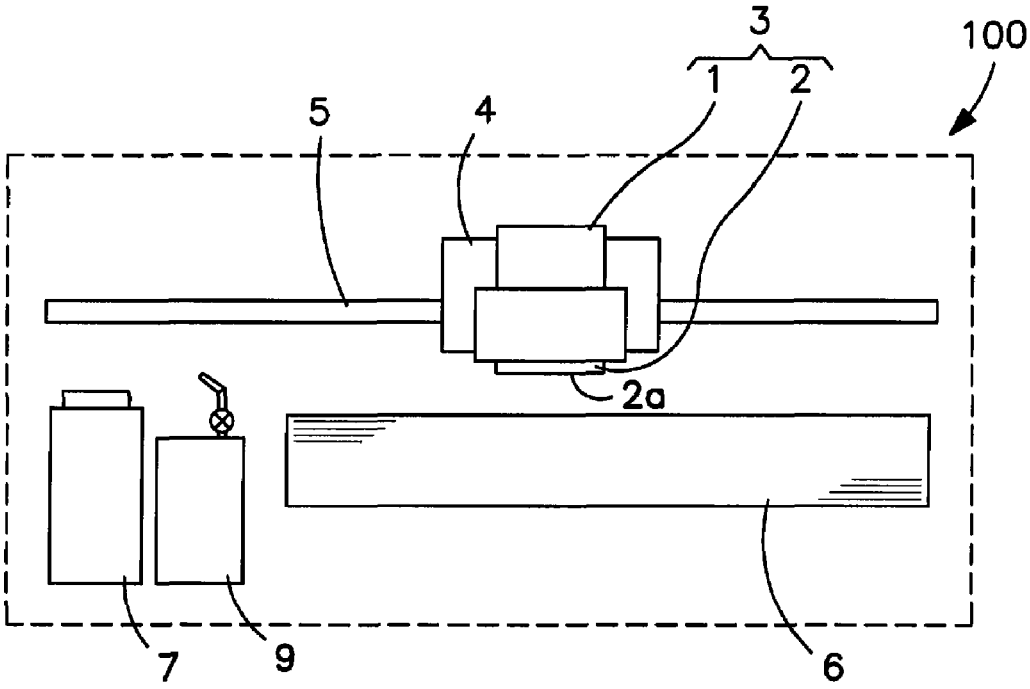
FIG. 1 is a schematic diagram showing an ink-jet recording apparatus according to an embodiment of the present invention.
Figure 3:
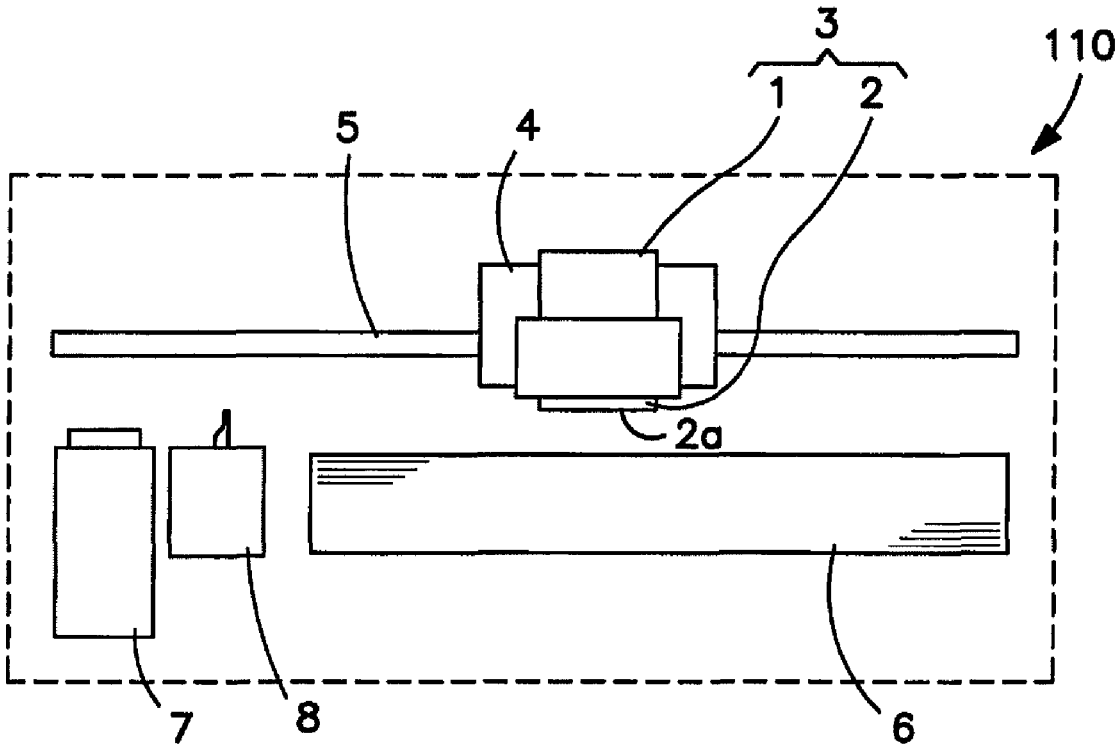
FIG. 3 PRIOR ART
FIG. 3 is a schematic diagram showing a conventional ink-jet recording apparatus.

An embodiment of an ink-jet recording apparatus according to the invention is schematically shown in FIG. 1. In the drawings, the same reference numeral denotes the same part. The ink-jet recording apparatus 100, in a same manner as in an ordinary ink-jet recording apparatus 110 shown in FIG. 3, comprises a carriage 4 in which an ink-jet head unit 3 having an ink cartridge 1 and an ink-jet head 2 is mounted, a carriage drive unit (not shown) which reciprocates the carriage 4 along a carriage guide rod 5, a platen roller 6 which is disposed opposite to the ink-jet head unit 3 and transports a recording paper, a purge device 7 which aspirates residual ink, which may contain bubbles or have an inappropriate composition, from the nozzle face 2*a* of the ink-jet head 2, and a cleaning device 9 which blows a gas to remove the ink or a foreign matter attached to a surface of the nozzle face 2*a*.

Figure 2:
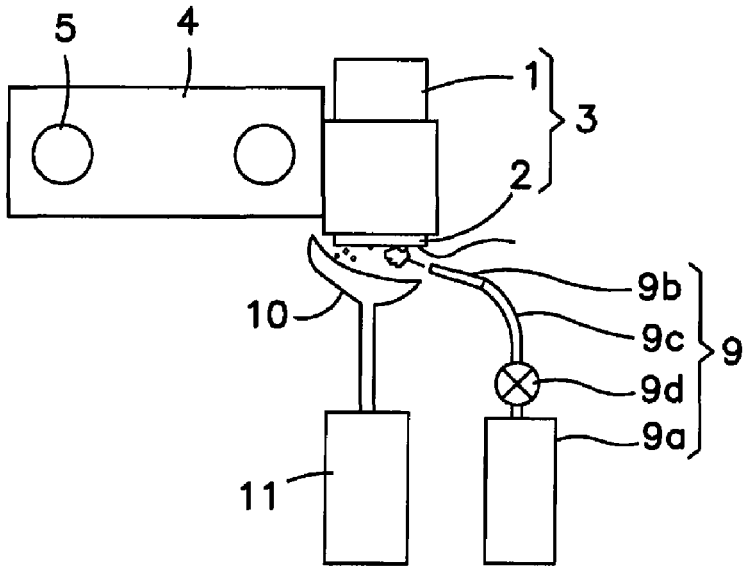
FIG. 2 is schematic diagram showing a cleaning device in the ink-jet recording apparatus of FIG. 1 according to an embodiment of the present invention.

This cleaning device 9 has, as shown in FIG. 2, a gas container 9*a* containing a compressed gas having a solubility in water lower than that of air in water, a gas injection tip 9*b* provided in the vicinity of the nozzle face 2*a* and a tube 9*c* which leads the gas from the gas container 9*a* to the gas injection tip 9*b*. Further, a regulator 9*d* for adjusting an injection pressure of the gas is optionally provided between the gas container 9*a* and the gas injection tip 9*b*. An ink catching receiver 10 for catching a water-based ink which is blown off the nozzle face 2*a* may also be provided. The ink caught by the ink catching receiver 10 may be collected in an ink waste tank 11. The contents of the ink waste tank 11 may be disposed of at an appropriate time.

In one ink-jet recording apparatus embodiment according to the invention, the gas having a solubility in water lower than that of air in water is used. This reduces the amount of the gas that becomes dissolved in the water-based ink during cleaning. Specifically, because the solubility of normal air in water is 0.0181 ml /1 ml of water, the solubility of the gas in water may be less than 0.0181 ml/1 ml of water. In a specific embodiment, the solubility of the gas in water may be 0.0150 ml/1 ml of water or less. As the solubility of the gas in water decreases, generation of bubbles in the water-based ink is increasingly suppressed. Accordingly, there may be no lower limit on the solubility of the gas in water.

A hydrophilic organic solvent such as glycerin or any one of glycols may be used in the water-based ink. Because a positive correlation exists between the solubility of the gas in water and the solubility thereof in the hydrophilic organic solvent, it may be sufficient to consider only the solubility of the gas in water when designing an apparatus according to the present invention.

In one embodiment, an inert gas may be used. In this instance, the term "inert gas" as used herein means a gas which does not corrode by oxidation a metallic member, particularly, an ordinarily widely used 42 alloy (Fe: 58%; Ni: 42%, in which a part of Ni is replaced by Co), in the vicinity of the nozzle. Specific examples of such inert gases include, but are not limited to, a nitrogen gas, a neon gas, a helium gas and a tetrafluoromethane gas.

When the gas is blown on the nozzle face 2*a*, if the pressure with which the gas is blown is too low, ink and foreign matter may not be removed. If the pressure with which the gas is blown is too high, there is a possibility of imparting a damage on the ink-jet head. In one embodiment, the gas may be blown at a pressure between about $1.0\times10^4$ Pa to about $1.0\times10^5$ Pa. Additionally, the gas may be blown perpendicular to the nozzle face 2*a* or at an angle. When the water-based ink to be blow off is to be caught, the angle may be adjusted to improve the efficiency with which the ink is caught. For example, the angle between the blown gas and the nozzle face 2*a* may be from about 30 degrees to about 60 degrees. The gas may be blown either in a pulse manner or continuously. It may be blown for a time duration of between about 0.5 seconds and about 1 second.

According to embodiments of the invention, qualities, shapes, sizes and the like of the gas container 9*a*, the gas injection tip 9*b*, the tube 9*c* and the regulator 9*d* which constitute the cleaning device 9 may appropriately be determined in accordance with intended performance of the ink-jet recording apparatus.

In another embodiment, components of the ink-jet recording apparatus for example, the ink-jet head, the purge device, the ink cartridge, the ink-jet head unit, the carriage, the carriage guide rod and the platen roller and the like, may be a component conventionally used. The recording medium on which the inkjet recording is performed may also be a recording medium conventionally used Water-based ink used in the ink-jet recording apparatus may also be ink conventionally used. However, in a further embodiment, the amount of dissolved oxygen in the water-based ink may be adjusted to be about 3.0 mg/l or less or even about 2.0 mg/l or less. If the amount of dissolved oxygen is greater than 3.0 mg/l, there is a tendency for increased printing failure when the ink is used in a recording apparatus according to an embodiment of the present invention. The amount of dissolved oxygen may be adjusted by degassing under a vacuum condition. Further, the amount of dissolved oxygen amount may be measured using an electrode method.

EXAMPLES

The following examples are provided only to illustrate certain embodiments of the description and are not intended to embody the total scope of the invention or any embodiment thereof. Variations of the exemplary embodiments below are intended to be included within the scope of the invention.

Ink in Examples 1 to 5 and Comparative Examples 1 to 5

The composition of black ink used to form Examples 1-5 and Comparative Examples 1-5 is described in Table 1.

TABLE 1

| Component | % by weight |
|---|---|
| Self-dispersing type carbon black dispersion liquid (15%) (CAB-O-JET ® 300; products of Cabot Corp.) | 35 |
| Glycerin | 30 |
| Triethylene glycol butyl ether | 3 |
| Ultra pure water | balance |

Black inks having a dissolved oxygen amount of 1.5 mg/l (Examples 1-4 and Comparative Examples 1-4) and 4.1 mg/l (Example 5 and Comparative Example 5) were prepared. The amount of dissolved oxygen amount in each ink was adjusted using a degassing operation under vacuum conditions. The amount of dissolved oxygen in each example and comparative example was measured using a dissolved oxygen meter (DO-OM14; manufactured by HORIBA, Ltd.).

Ink-jet Recording Apparatus

A digital multifunction machine mounted with an ink-jet printer (MFC-5100J; manufactured by Brother Industries, Ltd.) was converted into a test ink-jet recording apparatus for by replacing a rubber wiper with a cleaning device utilizing a compressed gas. A printing test was performed on plain paper as described below. In the test equipment, the cleaning device comprised a transparent polyvinyl-chloride tube having an inner diameter of 1.5 mm connected to a regulator of a gas container made of aluminum having a holding capacity of 500 ml and filled with a compressed gas. Further, a gas injection tip made of tetrafluoroethylene having an inner diameter of 1.5 mm, a tip opening diameter of 1.0 mm and a length of 1.0 cm was fixed to a leading end of the polyvinyl-chloride tube.

Printing Test

After the black ink shown in Table 1 having each of the adjusted dissolved oxygen amounts was ejected using the test ink-jet recording apparatus, each gas shown in Table 2 below was blown from the gas injection tip onto the nozzle face of the ink-jet head at an angle of 45 degrees to the nozzle face with an injection pressure (in terms of regulator pressure) of $1.0\times10^4$ Pa for 1.0 second, to thereby remove ink or a foreign matter attached to the nozzle face. Thereafter, the black ink was ejected from all of the nozzle orifices (150 in number) on the nozzle face. The number of nozzle orifices which experienced printing failures was counted. The printing test was repeated 10 times, and then an average of the printing failures was calculated to thereby determine a rate of printing failure occurrence. The test results are shown in Table 2.

TABLE 2

| | Type of gas | Solubility [ml/1 ml of water] | Dissolved oxygen amount of ink [mg/l] | Printing failure rate [%] |
|---|---|---|---|---|
| Example 1 | Nitrogen | 0.0147 | 1.5 | 2.4 |
| Example 2 | Neon | 0.0101 | 1.5 | 1.3 |
| Example 3 | Helium | 0.0087 | 1.5 | 0.6 |
| Example 4 | Tetrafluoro methane | 0.0047 | 1.5 | 0.5 |
| Comparative Example 1 | Air | 0.0181 | 1.5 | 2.7 |
| Comparative Example 2 | Oxygen | 0.0285 | 1.5 | 3.5 |
| Comparative | Argon | 0.0313 | 1.5 | 3.7 |

TABLE 2-continued

| | Type of gas | Solubility [ml/1 ml of water] | Dissolved oxygen amount of ink [mg/l] | Printing failure rate [%] |
|---|---|---|---|---|
| Example 3 | | | | |
| Comparative Example 4 | Carbon dioxide | 1.0535 | 1.5 | 5.2 |
| Example 5 | Nitrogen | 0.0147 | 4.1 | 3.8 |
| Comparative Example 5 | Air | 0.0181 | 4.1 | 4.3 |

As the results of Examples 1 to 4 and Comparative Examples 1 to 4 shown in Table 2 indicate, when the gas having a lower solubility in water than in the air was blown onto the nozzle, the printing failure rate was improved. Further, the results of Example 5 and Comparative Example 5 show that, when an ink having a larger dissolved oxygen amount was used, when a gas having a solubility in water lower than that of air in water was blown, the printing failure rate was improved. However, based upon a comparison between Example 1 and Example 5, and a further comparison between Comparative Example 1 and Comparative Example 5, it is appears that the water-based ink having a smaller dissolved oxygen amount showed more improvement in the printing failure rate that the water-based ink having a larger dissolved oxygen amount. Accordingly an ink having a smaller amount of dissolved oxygen may be used.

Although embodiments of the present invention have been described in detail herein, the scope of the invention is not limited thereto. It will be appreciated by those of ordinary skill in the relevant art that various modifications may be made without departing from the scope of the invention. Accordingly, the embodiments disclosed herein are exemplary. It is to be understood that the scope of the invention is not to be limited thereby, but is to be determined by the claims which follow.

What is claimed is:

1. An ink-jet recording apparatus comprising:

a nozzle provided on a nozzle face of an ink-jet head; and a cleaning device configured to clean the nozzle face by blowing a gas at the nozzle face at a pressure between about $1.0\times10^4$ Pa and about $1.0\times10^5$ Pa, wherein the gas has a solubility in water lower than a solubility in water of air at the nozzle face, wherein the cleaning device comprises:

a gas container in which the gas is contained in a compressed state;

a gas injection tip directed at the nozzle face; and a tube which connects the gas container and the gas injection tip.

2. The ink-jet recording apparatus according to claim 1, wherein the cleaning device further comprises a regulator for adjusting an injection pressure of the gas provided between the gas container and the gas injection tip.

3. The ink-jet recording apparatus according to claim 1, wherein the solubility of the gas in 1 ml of water is less than about 0.0181 ml.

4. The ink-jet recording apparatus according to claim 1, wherein the injection tip is disposed at an angle of between about 30 degrees and about 60 degrees to the nozzle face.

5. The ink-jet recording apparatus according to claim 1, wherein the gas comprises an inert gas.

6. The ink-jet recording apparatus according to claim 1, wherein the gas is selected from the group consisting of: a nitrogen gas, a neon gas, a helium gas, a tetrafluoromethane gas, and any combinations thereof.

7. The ink-jet recording apparatus according to claim 1, further comprising a water-based ink comprising about 3.0 mg/l or less dissolved oxygen.

8. The ink-jet recording apparatus of claim 1, wherein the gas injection tip is directed at the nozzle face from outside of the ink-jet head.

9. The ink-jet recording apparatus of claim 1, wherein the gas injection means is directed at the nozzle face from outside of the ink-jet head.

10. An ink-jet recording apparatus comprising:

a nozzle provided on a nozzle face of an ink-jet head; and a cleaning means for cleaning the nozzle face by blowing the gas at the nozzle face at a pressure between about $1.0\times10^4$ Pa and about $1.0\times10^5$ Pa, wherein the cleaning means comprises:

a gas containment means for containing the gas in a compressed state;

a gas injection means for directing the gas towards the nozzle face; and connecting means for connecting the gas containment means and the gas injection means.

11. The ink-jet recording apparatus according to claim 10, wherein the cleaning means further comprises a regulator means for adjusting an injection pressure of the gas.

12. A method of cleaning a nozzle face of an ink-jet head comprising blowing a gas at the nozzle face at a pressure between about $1.0\times10^4$ Pa and about $1.0\times10^5$ Pa, wherein the gas has a solubility in water lower than that of air in water at the nozzle face of the ink-jet head.

13. The method according to claim 12, wherein the solubility of the gas in 1 ml of water is less than about 0.0181 ml.

14. The method according to claim 12, wherein the gas is blown at an angle of between about 30 degrees and about 60 degrees to the nozzle face.

15. The method according to claim 12, wherein the gas comprises an inert gas.

16. The method according to claim 12, further comprising a water-based ink comprising about 3.0 mg/l or less dissolved oxygen.

17. The method according to claim 12, further comprising suppressing bubble formation in a water-based ink contained in an ink-jet head unit with the ink-jet head.

18. The method according to claim 12, wherein blowing comprises regulating an injection pressure of the gas.

19. The method according to claim 12, wherein blowing occurs for a time duration of between about 0.5 seconds and about 1 second.

* * * * *